United States Patent [19]

Huang

[11] Patent Number: 5,042,854

[45] Date of Patent: Aug. 27, 1991

[54] LATCH ASSEMBLY

[76] Inventor: Yu-Hwei Huang, 1 fl. No. 5, Alley 2, Lane 85, Min Tsu Rd., Lu Chou Hsiang, Taipei Hsien, Taiwan

[21] Appl. No.: 452,969

[22] Filed: Dec. 19, 1989

[51] Int. Cl.[5] ..... E05C 1/10

[52] U.S. Cl. ..... 292/175; 292/163

[58] Field of Search ..... 292/57, 60, 61, 175, 292/DIG. 27, 163, 137, 145

[56] References Cited

U.S. PATENT DOCUMENTS

| | | | |
|---|---|---|---|
| 472,088 | 4/1892 | Walker | 292/175 |
| 1,396,478 | 11/1921 | Turney | 292/57 |
| 1,620,749 | 3/1927 | Bartak | 292/175 X |
| 1,885,186 | 11/1932 | Defoy | 292/175 |
| 2,038,827 | 4/1936 | Carvette | 292/175 X |
| 2,518,207 | 8/1950 | Wagner | 292/175 |
| 2,692,789 | 10/1954 | Rivard | 292/175 X |
| 2,912,845 | 11/1959 | Mordovanecy | 292/57 X |
| 3,233,932 | 2/1966 | Utterback | 292/175 |
| 4,167,835 | 9/1979 | Nobes et al. | 292/175 X |
| 4,771,574 | 9/1988 | Stephens | 292/175 X |

FOREIGN PATENT DOCUMENTS

| | | | |
|---|---|---|---|
| 880606 | 3/1943 | France | 292/175 |

*Primary Examiner*—Gary L. Smith
*Assistant Examiner*—Michael J. Milano
*Attorney, Agent, or Firm*—Ostrolenk, Faber, Gerb & Soffen

[57] ABSTRACT

A latch assembly includes a latch that can reciprocatingly move between an extended, latching position and a retracted, unlatching position. A latch-guiding lever having a recessed slot extends into a transverse hole in the latch. A plug member under the elastic force of a spring is urged into the recessed slot, thereby preventing any loosening or slipping-off of the latch-guiding lever from the latch. A pull element may be provided to separate the plug member from the latch-guiding lever to thereby enable disassembly of the latch assembly.

4 Claims, 3 Drawing Sheets

LATCH ASSEMBLY

BACKGROUND OF THE INVENTION

The present invention relates to a latch assembly, including a latch and a latch-guiding lever, which can reciprocatingly move between an extended, latching position and a retracted, unlatching position and, in particular, such a latch assembly which prevents slippage between the latch and the latch-guiding lever.

Known latch or latch locking structures usually use a spring to position the latch at the latched position and a manual latch-guiding lever to push the latch to the retracted position. The latch and latch-guiding lever are usually assembled using conventional threaded joint or press-on packing assembly methods. However, such conventional methods of assembly often cause damage, particularly to the threads, or looseness of the component parts of the latch assembly, due to use over an extended period of time or infrequent pushes or excessive external forces. Indeed, the latch-guiding lever may even loosen and slip off from the latch, causing the latch or latch-locking assembly to lose its assigned function and thereby cause extreme user difficulties.

With respect to latch-guiding levers and latches that are assembled by means of thread connections, troubles may be generated due to the extent to which the threads are tightened. If they are overly tightened, this will increase the diameter of the head of the latch-guiding lever causing excessive friction between the lever and its guide slot wall, thereby making it more difficult for users to push the latch-guiding lever; if they are not tightened sufficiently, this will make the latch-guiding lever protrude outside too much, thereby causing the latch-guiding lever to easily loosen and even slip off from the latch.

To overcome the problem of the latch-guiding lever loosening and slipping off, inverse installed screws and clamp spring packing means have been used to replace the conventional screw assembly. Although this solved the loosening and slipping-off phenomenon of the latch-guiding lever, it added difficulties during assembly, caused inconvenience to users and added higher costs.

From the foregoing, it should be evident that a latch assembly that is easy to assemble and can also avoid the loosening and slipping off of the latch-guiding lever is needed.

SUMMARY OF THE INVENTION

Accordingly, an object of the present invention to provide a latch assembly that can actually prevent the latch-guiding lever from getting loose or slipping off, whose assembly is convenient and simple, and whose latch-guiding lever may be easily and conventionally pushed.

Another object of the present invention is to provide a latch assembly of the above type in a simple design and economic construction for easy assembly, disassembly and replacement, thereby lowering both manufacturing and maintenance costs.

A latch assembly in accordance with the foregoing and other objects, comprises an outside housing element and a latch that can reciprocatingly move between an extended, latching position and a retracted, unlatching position. A transverse hole is provided in the latch. A manually controlled latch-guiding lever is partly extended into the hole in the latch. A recessed slot is provided on the part of the latch that it inserted into the hole in the latch. Under the elastic force of a spring, a portion of a plug member is urged into the recessed hole to prevent the latch-guiding lever from loosening and slipping off the latch. A pull element is provided to pull the plug member and separate it from the latch-guiding lever, thereby enabling disassembly of the latch assembly.

BRIEF DESCRIPTION OF THE DRAWINGS

The invention, as well as its objects, advantages and features, will be more readily understood from the following detailed description, when considered in conjunction with the appended drawings, in which.

DETAILED DESCRIPTION OF THE PREFERRED EMBODIMENTS

Figure 1:
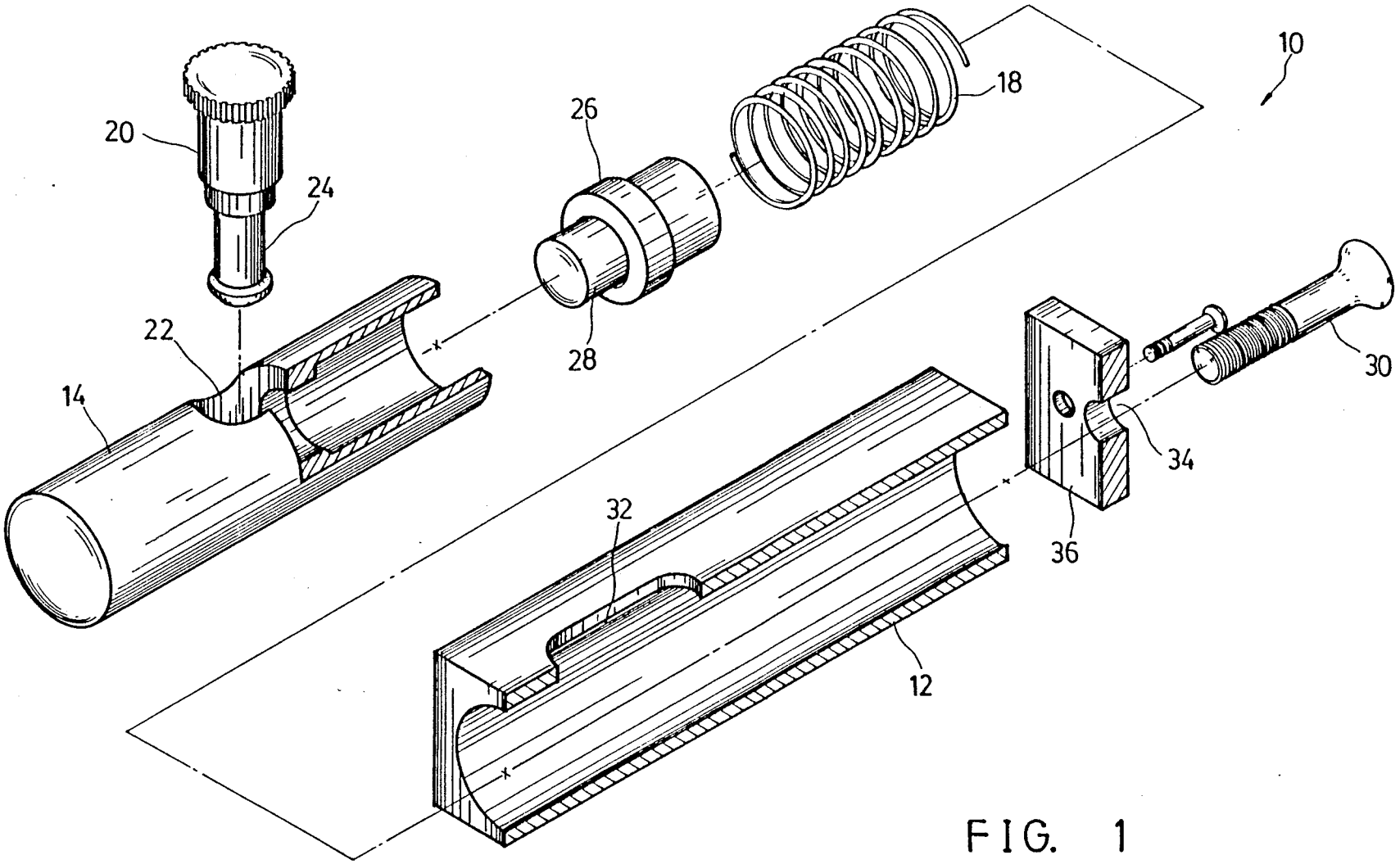
FIG. 1 is an exploded view of various component elements of a first embodiment of a latch assembly in accordance with the present invention.
Figure 2:
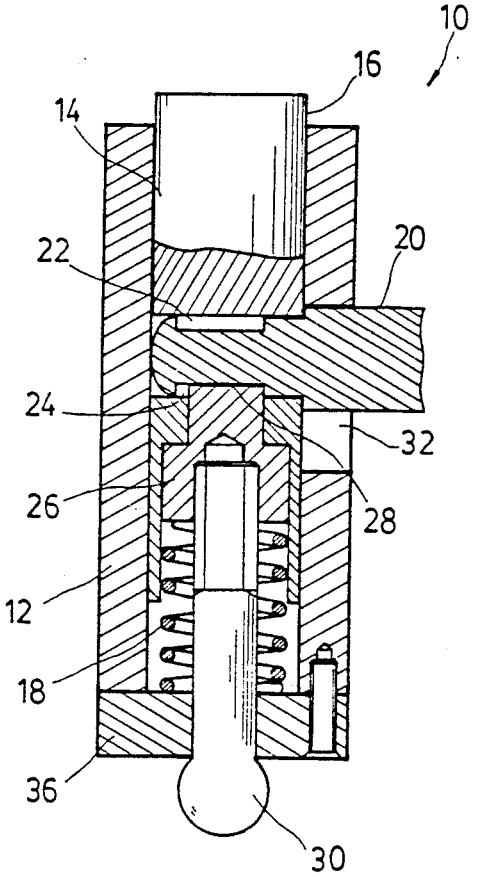
FIG. 2 is an elevational, sectional view of the assembled component elements of the embodiment shown in FIG. 1.

Referring now to FIGS. 1 and 2 of the drawings, a first embodiment of a latch assembly 10 in accordance with the present invention includes an outside housing element 12 which can be made in any type and form to match different uses, for instance, the latch assembly 10 may be made into a door latch, window latch, suit case latch, key chain latch, file clamp and so on. The latch assembly 10 includes a latch 14 which is enclosed in the outside housing element 12 with a part 16 of the latch 14 protruding outside of the outside housing element 12 to achieve the latching action for an article (not shown). The latch 14 can reciprocatingly move from the latching position or the completely extended position, as shown in FIG. 2, to the retracted position inside the outside housing element 12. One feature of the present invention lies in the provision of a radial hole 22, which may be a through-hole, in a suitable position of the latch 14 to allow a latch-guiding lever 20 to extend therein. A recessed slot 24 is provided on the part of the latch-guiding lever 20 that extends into the hole 22. A plug member 26 is positioned between the latch-guiding lever 20 and a compression spring so that the spring 18 causes a head 28 of the plug member 26 to extend into the hole 22 and to bear against the recessed slot 24 of the latch-guiding lever 20. Accordingly, the plug member 26 prevents the latch-guiding lever 20 from being pulled out of the hole 22, thereby preventing any loosening and slipping-off between the latch 14 and the latch-guiding lever 20.

The latch assembly 10 also includes an axial pull element 30 having one end fixed to the plug member 26. If necessary to disassemble the latch assembly 10, the pull element 30 may be pulled manually to remove the head 28 of the plug member 26 from the recessed slot 24 of the latch-guiding lever 20, thereby enabling the latch-guiding lever 20 to be freely pulled out of the hole 22 to separate the latch 14 and disassemble the latch assembly 10.

There are two kinds of action force to make the latch 14 move. One is an outward push force under the action of the compression spring 18, which moves and maintains the latch 14 at the latching position; the other is an inward pull force exerted on the latch 14 when the user pushes the latch-guiding lever 20 with his hand and can last until the latch 14 moves to the retracted position to lose its latching action.

When the latch 14 moves, all the members of the latch assembly 10, except the outside housing element 12, will synchronously move with the latch 14, and such members refer to the latch 14, the latch-guiding lever 20, the plug member 26, the spring 18 and the pull element 30. To facilitate such movement, a slot 32 is provided on the outside housing element 12 to allow movement of the latch-guiding lever 20. The slot 32 also limits the positions of the dead points for the latch-guiding lever 20 and other members during their reciprocating travels. Further, a hole 34 is provided on an end plate 36 attached at the end of the outside housing element 12 to allow the axial push element 30 to reciprocate.

Figure 3:
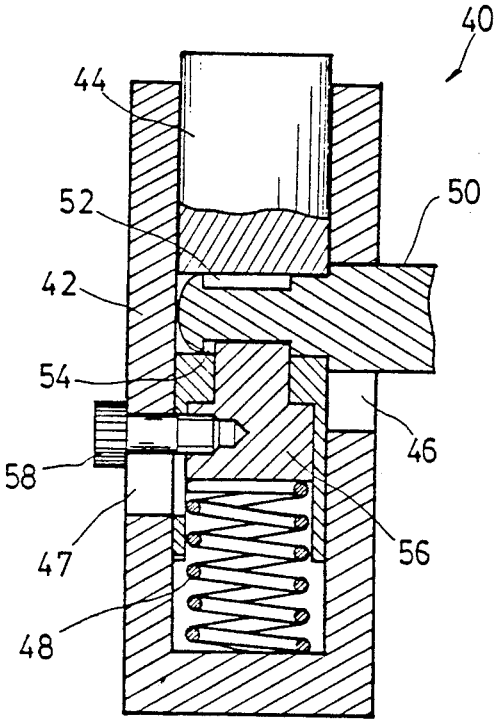
FIG. 3 is an elevational, sectional view of a second embodiment of a latch assembly in accordance with the present invention.

Referring now to FIG. 3, there is shown a second embodiment of a latch assembly 40 in accordance with the invention. The latch assembly 40 comprises an outside housing element 42 of any suitable type to match the use of the latch assembly, a latch 44 that can reciprocatingly move between an extended, latching position and a retracted, unlatched position, a latch-guiding lever 50 that can extend into a radial hole 52 in the latch 44, a plug member 56 that can be placed into a recessed slot 54 on the latch-guiding lever, and a compression spring 48 that generates a push force for the latch 44 and plug member 56. The difference between the latch assembly 40 and the latch assembly 10 of the first embodiment, is that the latch assembly 40 includes a pull element 58 which is radially positioned with respect to the plug member 56. One end of the pull element 58 is fixed to the plug member 56 to facilitate applying a force to the plug member 56 to axially separate it from the recessed slot 54 on the latch-guiding lever 50. Two slot holes 46 and 47 in an equal length are respectively provided on the outside housing element 42 to respectively allow the radial latch-guiding lever 50 and pull element 58 to have limited reciprocating movements.

Figure 4:
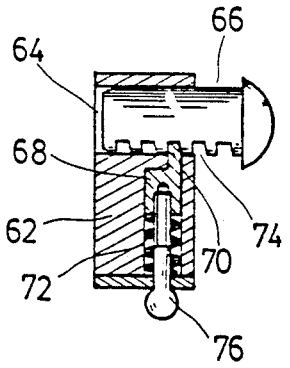
FIG. 4 is an elevational, sectional view of a third embodiment of a latch assembly in accordance with the present invention.

Turning now to FIG. 4, there is shown an embodiment of the invention useful as a file clamp or any other similar article. This embodiment comprises an outside housing element 62 on which a radial hole 64 is provided to allow a tooth-shaped rod 66 to be inserted therein; a plug member 68 having a head 70; a spring 72; and an axial pull element 76. Under the elastic force of the spring 72, the head 70 of the plug member 68 may be laid into any tooth valley 74 of the tooth-shaped rod 66. The pull element 76 is used to manually pull the head 70 of the plug member out of the tooth valley 74 of the tooth-shaped rod.

Figure 5:
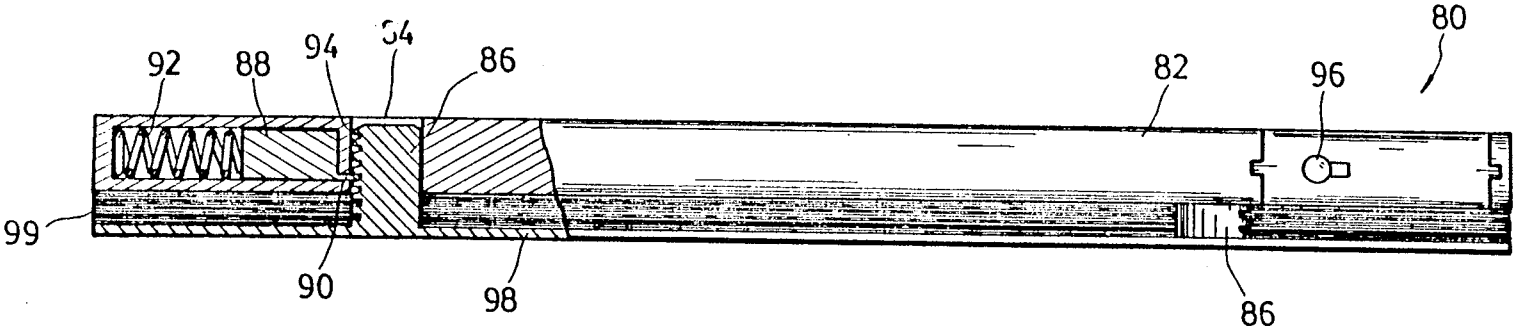
FIG. 5 is a view, partly in section, of a file clamp incorporating a latch assembly in accordance with the third embodiment of the invention.

Referring now to FIG. 5, there is shown the embodiment of FIG. 4 used as a file clamp for a classic adjustable file assembly 80. The file assembly 80 has an outside housing element 82 which is appropriately lengthened to accommodate a file clamp at each end thereof. Each file clamp includes a hole 84 into which a tooth-shaped rod 86 is inserted. Each rod 86 is fixed to respective opposite ends of a holding plate 98. Each file clamp further includes a plug member 88; a spring 92; and a radial pull element 96. The heads 90 of the two plug members are inserted into appropriate tooth valleys 94 of the tooth-shaped rods 86 to firmly clamp a document 90. The specific tooth valleys 94 into which the heads 90 are inserted depends upon the thickness of the document to be clamped.

Figure 6:
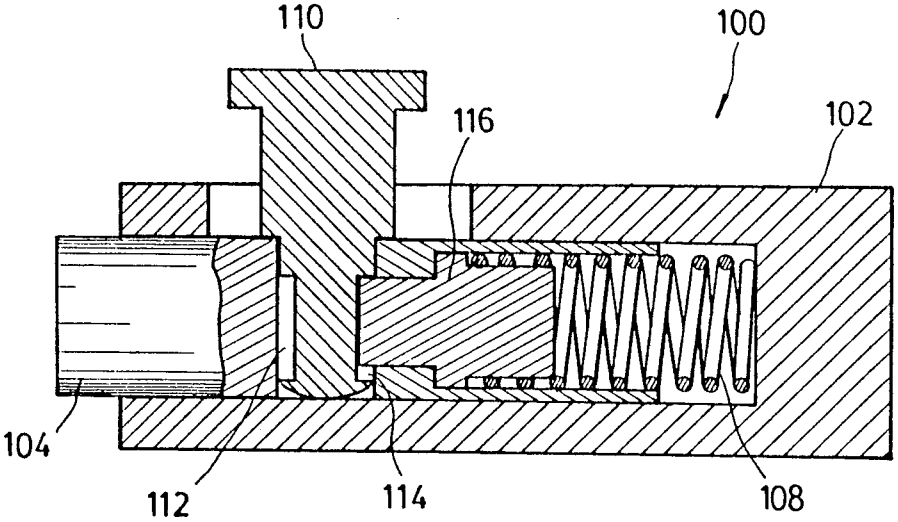
FIG. 6 is an elevational, sectional view of a fourth embodiment of a latch assembly in accordance with the present invention.

Turning now to FIG. 6, there is shown a fourth embodiment of a latch assembly 100 in accordance with the invention. The latch assembly 100 comprises an outside housing element 102 of any suitable type to match the use of the latch assembly, a latch 104 that can reciprocatingly move between an extended latching position and a retracted, unlatched position; a latch-guiding lever 110 that can extend into a radial hole 112 in the latch 104; a plug member 116 that can be placed into a recessed slot 114 in the latch-guiding lever, and a spring 108 that generates a push force to the latch 104 and the plug member 116. The latch assembly 100 differs from the latch assembly 10 of the first embodiment and the latch assembly 40 of the second exemplary embodiment in that the latch assembly 100 is not provided with any means to separately pull the plug member 116. However, like the other embodiments, the latch assembly 106 also prevents the latch-guiding latch 110 from loosening or slipping-off from the latch 104, but its structure is simplified to lower its manufacture costs.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. A latch assembly comprising:

an outside housing element;

a latch in said housing element, said latch having an axis and being axially reciprocatable between an extended, latching position and a retracted, unlatching position and being provided with a hole transverse to said axis;

a manual latch-guiding lever having a part thereof extending into said hole in the latch, said part being provided with a recessed slot;

a plug member axially aligned with said latch;

a spring for urging a part of said plug member into said recessed slot on the said latch-guiding lever; and a manual pull element, one end of which is fixed on said plug member, and the other end of which can be manually pulled to move the plug member and separate said plug member from the latch-guiding lever.

2. The latch assembly recited in claim 1, wherein said pull element is axially aligned with said plug member.

3. The latch assembly recited in claim 1, wherein said pull element is transverse to said axis.

4. A latch assembly comprising:

an outside housing element;

a latch in said housing element, said latch having an axis and being axially reciprocatable between an extended, latching position and a retracted, unlatching position and being provided with a hole transverse to said axis;

a manual latch-guiding lever having a part thereof extending into said hole in said latch, said part being provided with a recessed slot; and a plug member axially aligned with said latch; and a spring for urging a part of said plug member into said recessed slot on the said latch-guiding lever.

* * * * *